US012285793B2

(12) United States Patent
Zheng et al.

(10) Patent No.: US 12,285,793 B2
(45) Date of Patent: Apr. 29, 2025

(54) FORMING DEVICE AND FORMING METHOD FOR PART WITH REGULAR CROSS-SECTION

(71) Applicants: Dalian University of Technology, Dalian (CN); AVIC Manufacturing Technology Institute, Beijing (CN)

(72) Inventors: Kailun Zheng, Dalian (CN); Dechong Li, Dalian (CN); Lihua Du, Beijing (CN); Yujie Han, Beijing (CN)

(73) Assignees: DALIAN UNIVERSITY OF TECHNOLOGY, Dalian (CN); AVIC MANUFACTURING TECHNOLOGY INSTITUTE, Beijing (CN)

( * ) Notice: Subject to any disclaimer, the term of this patent is extended or adjusted under 35 U.S.C. 154(b) by 0 days.

(21) Appl. No.: 18/622,974

(22) Filed: Mar. 31, 2024

(65) Prior Publication Data

US 2025/0083209 A1 Mar. 13, 2025

(30) Foreign Application Priority Data

Sep. 11, 2023 (CN) ..... 202311165068.0

(51) Int. Cl.
*B21D 37/16* (2006.01)
*B21D 22/02* (2006.01)

(52) U.S. Cl.
CPC ..... *B21D 22/022* (2013.01); *B21D 37/16* (2013.01)

(58) Field of Classification Search
CPC .... B21D 22/022; B21D 22/208; B21D 37/16; C21D 1/40
See application file for complete search history.

(56) References Cited

U.S. PATENT DOCUMENTS 2,961,028 A * 11/1960 Bath ..... B21D 25/02 72/414
6,910,358 B2 * 6/2005 Schroth ..... B21D 22/02 72/342.7
7,732,734 B2 * 6/2010 Machrowicz ..... H05B 3/0014 219/161
8,653,399 B2 * 2/2014 Seid ..... H05B 3/0004 219/161
8,661,869 B2 * 3/2014 Polen ..... B21D 11/02 72/364
9,392,644 B2 * 7/2016 Nojiri ..... H05B 3/0009
(Continued)

OTHER PUBLICATIONS

KR 20210009004A, Seo et al. Jan. 2021.*
WO 20180061113A1, Metz Jan. 2018.*

*Primary Examiner* — Edward T Tolan
(74) *Attorney, Agent, or Firm* — Curatolo Sidoti & Trillis Co., LPA; Floyd Trillis, III; Salvatore A. Sidoti

(57) ABSTRACT

A forming device and a forming method for a part with a regular cross-section are provided, and relates to the technical field of metal member forming and manufacturing. A part to be formed is heated by a part heating temperature control assembly to obtain required microstructure evolution, so that the forming performance is improved. A temperature control die assembly can be heated by setting die heating assemblies, so that hot stamping, die quenching and stress relaxation can be carried out. The internal stress state of the part is controlled by an axial force control assembly.

16 Claims, 7 Drawing Sheets

(56) References Cited

U.S. PATENT DOCUMENTS

| | | | | |
|---|---|---|---|---|
| 2006/0075799 | A1* | 4/2006 | Schroth | B21D 37/16<br>72/342.8 |
| 2014/0312024 | A1* | 10/2014 | Egawa | B21D 11/02<br>219/149 |

* cited by examiner

FORMING DEVICE AND FORMING METHOD FOR PART WITH REGULAR CROSS-SECTION

CROSS-REFERENCE TO RELATED APPLICATION

This patent application claims the benefit and priority of Chinese Patent Application No. 2023111650680 filed with the China National Intellectual Property Administration on Sep. 11, 2023, the disclosure of which is incorporated by reference herein in its entirety as part of the present application.

TECHNICAL FIELD

The present disclosure relates to the technical field of metal member forming and manufacturing, and in particular to a forming device and a forming method for a part with a regular cross-section.

BACKGROUND

Stringer structures with a regular cross section are important structures in aerospace and missiles, such as skin stringers in the interstage sections of launch vehicles and the skin stringers in the shell sections of tactical missiles. The stringer structures mainly play a role in supporting the skin and are used for withstanding axial compression loads, internal pressures and bending moments, and the quality and performance of the stringer structures will directly affect the overall structural strength of the equipment. With regular cross-section characteristics, the stringer structures need to be connected to the inner surface of the skin by riveting etc., and the precision requirement is high. In order to further reduce the weight of the equipment and improve structural efficiency, reliability and service performance, titanium alloy is urgently needed to replace the existing structural materials such as aluminum alloy and stainless steel. Titanium alloy has low Young's modulus at room temperature and poor plasticity, and large springback of the formed part and low precision, so it is necessary to increase the forming temperature so as to improve the formability. At present, the existing conventional high-temperature forming methods mainly include superplastic forming method, isothermal compression forming method and cold die hot stamping method.

Superplastic forming method is a forming process that utilizes the high elongation of the metal material obtained under specific temperature and strain rate conditions to process the sheet so as to obtain a part with a required size and shape. However, due to high forming temperature and slow deformation rate of superplastic forming method, it is difficult to ensure the microstructure properties and dimensional precision of the formed part at the same time, and it is easy to cause significant local thinning and performance weakening. And superplastic forming method is limited to fine-grained materials and certain equipment sizes, resulting in high manufacturing cost and low production efficiency, so it is difficult to meet the needs of large-scale production of the part.

Isothermal compression forming method involves heating the sheet and the dies to the same temperature at the same time, and then carrying out stamping deformation. This method can improve the formability of titanium alloy sheet to a great extent, but it needs high temperature resistant die materials, resulting in high manufacturing and maintenance costs of the dies, and high forming temperature and energy consumption limit its application in the aerospace field to a certain extent. In addition, during the process of isothermal compression forming, the sheet and the dies need to maintain high temperature and pressure for a long time, so that the production efficiency of the titanium alloy thin-walled member is reduced, and energy consumption is increased. Moreover, during the process of forming, the titanium alloy sheet stays for a long time during the high temperature stage, resulting in serious surface oxidation and rapidly coarsening of the internal structure. These problems will seriously affect the service performance of the part.

The main process of cold die hot stamping method involves several steps, such as sheet heating, sheet transferring, stamping, dies closing and pressure maintaining, and artificial aging. In this method, hot forming and heat treatment are combined in a single process, so that the formability and production efficiency of the sheet are greatly improved. However, during the process of sheet transferring and stamping, a significant amount of heat is lost, resulting in inconsistent forming temperature and heating temperature, so it is difficult to use for forming the titanium alloy sheet with high temperature sensitivity.

To sum up, the existing high-temperature forming methods cannot meet the forming requirements of thin-walled structures with a regular cross section, such as titanium alloy stringers, in the aerospace field due to various limitations. Therefore, it is urgent to propose a high-precision forming technology for titanium alloy to solve the manufacturing problem of coupling the forming precision and microstructure properties of the titanium alloy thin-walled member so as to solve the bottleneck problem of precision forming of a titanium alloy thin-walled member with a regular cross section.

SUMMARY

The purpose of the present disclosure is to provide a forming device and a forming method for a part with a regular cross-section. The forming device can realize high-precision forming of titanium alloy so as to solve the manufacturing problem of coupling forming precision and microstructure properties of the existing titanium alloy thin-walled member.

In order to achieve the purpose, the present disclosure provides the following solution.

The present disclosure provides a forming device for a part with a regular cross-section, including:

a temperature control die assembly, including a first stamping die and a second stamping die adapted to the first stamping die, a first die heating assembly being arranged on the first stamping die and a second die heating assembly being arranged on the second stamping die;

a closing driving assembly connected with at least one of the first stamping die and the second stamping die and configured for driving the first stamping die and the second stamping die to close so as to stamp a part to be formed;

a part heating temperature control assembly configured for heating the part to be formed;

an axial force control assembly configured for applying an axial force to the part to be formed during a process of heating expansion or stamping contraction of the part to be formed, a direction of the axial force is perpendicular to a closing direction of the first stamping die and the second stamping die to adjust an internal stress of the part to be formed; and a control system in communication with the axial force control assembly, the part heating temperature control assembly, the closing driving assembly, the first die heating assembly and the second die heating assembly.

Optionally, the first stamping die and the second stamping die are arranged vertically. The axial force control assembly includes a first horizontal telescopic part and a second horizontal telescopic part located on both sides of the second stamping die. The first horizontal telescopic part and the second horizontal telescopic part are configured for both connecting with the part to be formed to realize stress control of the part to be formed through synchronous expansion and contraction.

Optionally, the closing driving assembly is a closing press. The closing press includes a worktable, a lifting driver, and a sliding block connected with the lifting driver. The lifting driver is located above the worktable. The second stamping die is arranged on the worktable. The first stamping die is connected with the sliding block.

Optionally, the forming device further includes: a first cooling structure arranged between the first stamping die and the sliding block; a first heat insulation structure arranged between the first cooling structure and the first stamping die;

a second cooling structure arranged between the second stamping die and the worktable; a second heat insulation structure arranged between the second cooling structure and the second stamping die.

Optionally, the first heat insulation structure and the second heat insulation structure are both heat insulation plates. The first cooling structure and the second cooling structure are both water cooling plates.

Optionally, the first die heating assembly includes first heating elements and first thermocouples. The first heating elements and the first thermocouples are both inserted at positions corresponding to the first stamping die.

The second die heating assembly includes second heating elements and second thermocouples. The second heating elements and the second thermocouples are both inserted at positions corresponding to the second stamping die.

Optionally, the axial force control assembly further includes force sensors. The force sensors are arranged on both the first horizontal telescopic part and the second horizontal telescopic part to detect an axial force of the part to be formed during the process of heating expansion or stamping contraction.

Optionally, the part heating temperature control assembly is a self-resistance heating system. The self-resistance heating system includes a high-frequency switching power supply, wires and metal electrodes. The metal electrodes are configured for closing the part to be formed. The metal electrodes are electrically connected with the high-frequency switching power supply through the wires. The part to be formed is connected with the first horizontal telescopic part and the second horizontal telescopic part through insulation structures.

Optionally, the first horizontal telescopic part and the second horizontal telescopic part are both horizontal cylinders.

The present disclosure also provides a forming method for a part with a regular cross-section, including the following steps:

heating stamping dies to temperature $T_1$, heating a part to be formed to temperature $T_2$, where $T_2$ is greater than $T_1$;

driving the stamping dies to close so as to stamp the part to be formed, obtaining a first preformed member;

applying a tensile axial force to the first preformed member to limit cooling contraction of the first preformed member and form a tensile stress within the first preformed member; and adjusting the temperature of the stamping dies and a closing pressure to cause stress relaxation of the first preformed member under a constant temperature $T_1$ and a constant closing pressure $P_1$, reducing springback of the first preformed member, and applying a constant tensile axial force to the first preformed member to eliminate residual stress in the first preformed member.

Compared with the prior art, the present disclosure has the following technical effects.

According to a forming device and a forming method for a part with a regular cross-section proposed by the present disclosure, a part to be formed is heated by a part heating temperature control assembly to obtain required microstructure evolution, so that the forming performance is improved. In the temperature control die assembly, the dies are heated by the die heating assemblies, so that hot stamping, die quenching and stress relaxation can be carried out. The internal stress state of the part is adjusted by the axial force control assembly. In the present disclosure, hot stamping and heat treatment are combined in a single process, so that the formability and production efficiency of the part are improved. Moreover, the strength and dimensional precision of the formed part can be increased though die quenching and stress relaxation. The cooperation of the temperature control die assembly and the axial force control assembly can realize multi-axis loading, the internal stress of the part can be reduced, and creep sizing can be carried out on the part, so that the springback caused by traditional cold stamping is effectively reduced, and the dimensional precision of the part is further increased.

The forming device and the forming method for a part with a regular cross-section provided by the present disclosure can realize multi-axis loading high-precision hot forming of a part with a regular cross-section, and is suitable for hot forming of a titanium alloy thin-walled member with a regular cross-section, so that the manufacturing problem of coupling forming precision and microstructure properties of the existing titanium alloy thin-walled member is solved.

BRIEF DESCRIPTION OF THE DRAWINGS

To more clearly illustrate the present embodiment of the present disclosure or the technical solution in the prior art, the following briefly introduces the attached figures to be used in the present embodiment. Apparently, the attached figures in the following description show merely some embodiments of the present disclosure, and those skilled in the art may obtain other figures from these attached figures without creative efforts.

REFERENCE SIGNS IN THE DRAWINGS

100, forming device for a part with a regular cross-section;

1, control system; 1-1, die displacement controller; 1-2, current controller; 1-3, axial force controller; 1-4, die temperature controller; 2, first stamping die; 3, second stamping die; 4, first horizontal telescopic part; 5, second horizontal telescopic part; 6, worktable; 7, lifting driver; 8, sliding block; 9, first cooling structure; 10, first heat insulation structure; 11, second cooling structure; 12, second heat insulation structure; 13, force sensor; 14, insulation structure; 15, metal electrode; 16, part to be formed; 17, first heating element; 18, first thermocouple; 19, second heating element; 20, second thermocouple.

DETAILED DESCRIPTION OF THE EMBODIMENTS

The following clearly and completely describes the technical solution in the embodiments of the present disclosure with reference to the embodiments of the present disclosure. Apparently, the described embodiments are merely a part rather than all of the embodiments of the present disclosure. Based on the embodiments in the present disclosure, all other embodiments obtained by the ordinary technical staff in the art without creative efforts belong to the scope protected by the present disclosure.

One purpose of the present disclosure is to provide a forming device for a part with a regular cross-section. The forming device can realize high-precision forming of titanium alloy so as to solve the manufacturing problem of coupling forming precision and microstructure properties of the existing titanium alloy thin-walled member.

Another purpose of the present disclosure is to provide a forming method for a part with a regular cross-section. The forming method can realize high-precision forming of titanium alloy so as to solve the manufacturing problem of coupling forming precision and microstructure properties of the existing titanium alloy thin-walled member.

To make the foregoing objective, features and advantages of the present disclosure clearer and easier to understand, the present disclosure is further described in detail below with reference to the attached figures and specific embodiments.

Embodiment I

Figure 1:
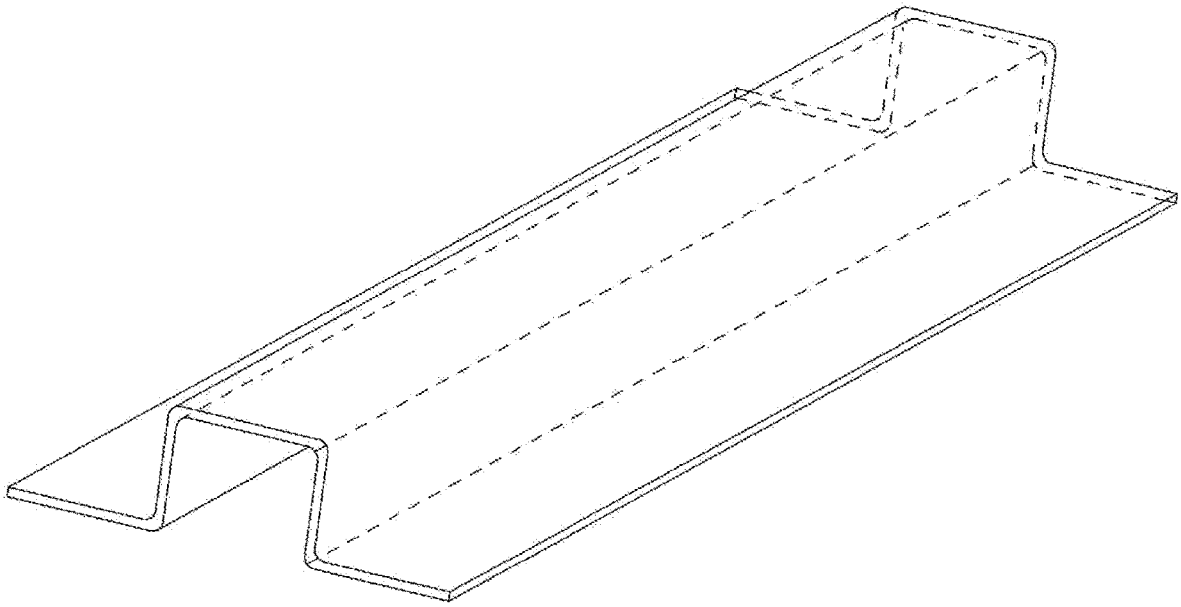
FIG. 1 is a structural schematic diagram of a titanium alloy regular cross-section part disclosed in an embodiment of the present disclosure.
Figure 2:
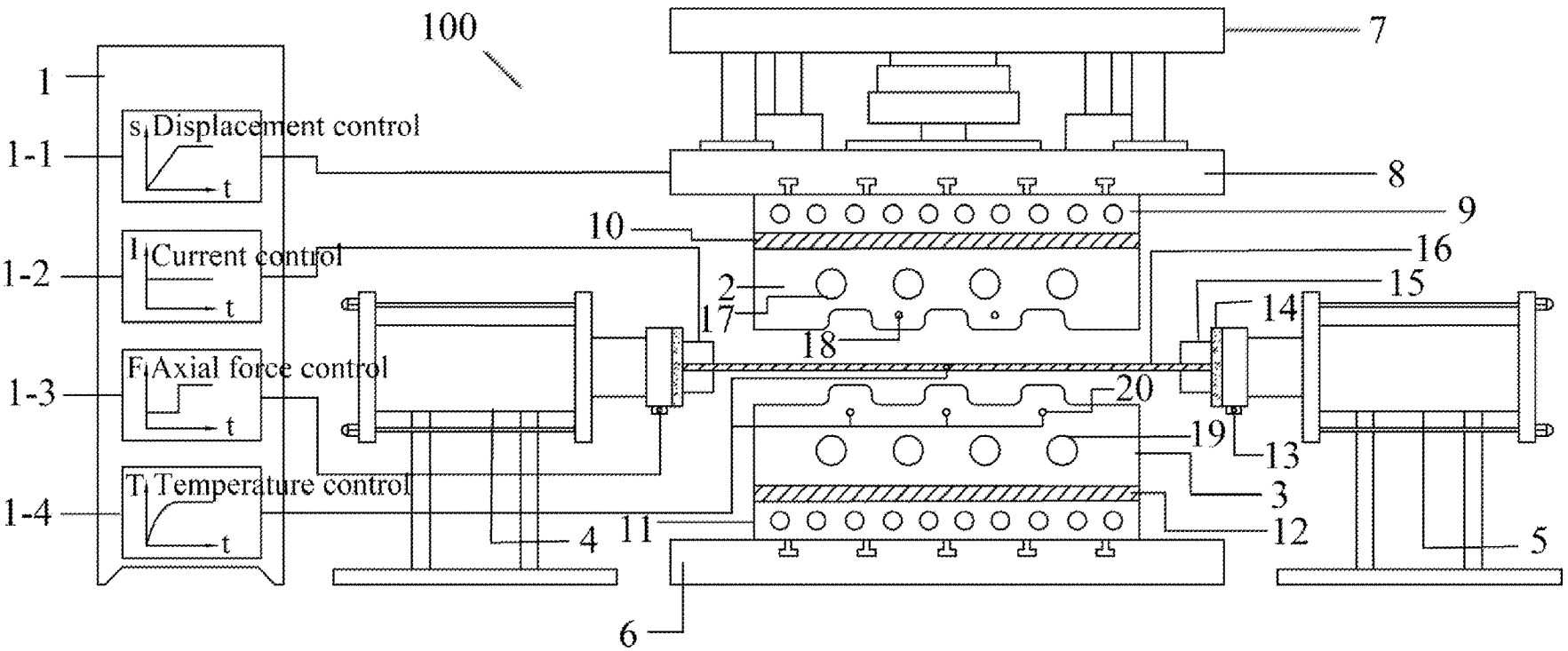
FIG. 2 is an integral structural schematic diagram of a forming device for a part with a regular cross-section disclosed in an embodiment of the present disclosure.
Figure 3:
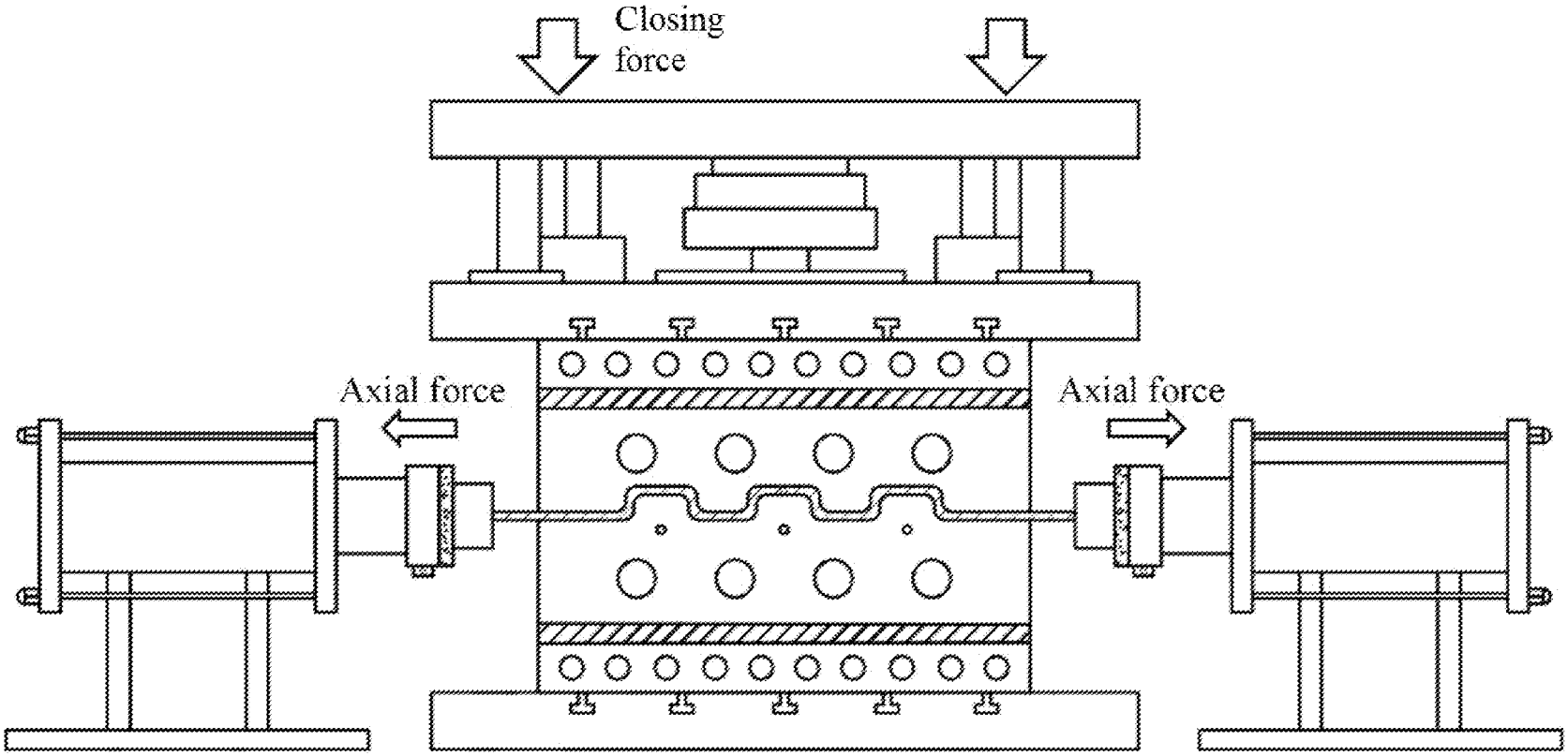
FIG. 3 is a structural schematic diagram of the forming device for a part with a regular cross-section disclosed in the embodiment of the present disclosure, wherein a first stamping die and a second stamping die are closed.

As shown in FIG. 1 and FIG. 2. The embodiment provides a forming device 100 for a part with a regular cross-section. The forming device includes a temperature control die assembly, a closing driving assembly, a part heating temperature control assembly, an axial force control assembly and a control system 1. The temperature control die assembly includes a first stamping die 2 and a second stamping die 3 adapted to the first stamping die 2. When the first stamping die 2 and the second stamping die 3 are closed, a cavity adapted to a contour of a finished product with a regular cross-section part is formed. A first die heating assembly and a second die heating assembly are arranged on the first stamping die 2 and the second stamping die 3, respectively. The first die heating assembly and the second die heating assembly are configured for heating the first stamping die 2 and the second stamping die 3, respectively. The closing driving assembly is connected with at least one of the first stamping die 2 and the second stamping die 3 and configured for driving the first stamping die 2 and the second stamping die 3 to close so as to stamp a part to be formed 16. The part heating temperature control assembly is configured for heating the part to be formed 16. The axial force control assembly is configured for applying an axial force to the part to be formed 16 during a process of heating expansion or stamping contraction of the part to be formed 16. The direction of the axial force is perpendicular to the closing direction of the first stamping die 2 and second stamping die 3 so as to control the internal stress of the part to be formed 16. Especially, after the part to be formed 16 is stamped, the cooling shrinkage of the part to be formed 16 can be effectively limited by applying a tensile axial force to the part to be formed 16 through the axial force control assembly. The control system 1 is in communication with the axial force control assembly, the part heating temperature control assembly, the closing driving assembly, the first die heating assembly and the second die heating assembly so as to receive operating parameters of each assembly in real time and automatically control operation of each assembly.

In the embodiment, the first stamping die 2 and the second stamping die 3 are usually arranged vertically. The axial force control assembly includes a first horizontal telescopic part 4 and a second horizontal telescopic part 5 located on both sides of the second stamping die 3. The first horizontal telescopic part 4 and the second horizontal telescopic part 5 are symmetrically arranged. The first horizontal telescopic part 4 and the second horizontal telescopic part 5 are configured for both connecting with the part to be formed 16 so as to stretch or compress the part to be formed 16 through synchronous expansion and contraction, thereby realizing stress control of the part to be formed 16.

In the embodiment, the closing driving assembly mainly plays a role in controlling the hot stamping strain rate and closing pressure of the part during the forming process. The closing driving assembly is usually a closing press. The closing press comprises a worktable 6, a lifting driver 7, and a sliding block 8 connected with the lifting driver 7. The lifting driver 7 is located above the worktable 6. The second stamping die 3 is arranged on the worktable 6. The first stamping die 2 is connected with the sliding block 8. The lifting driver 7 drives the sliding block 8 to lift and lower, and then drives the first stamping die 2 to lift and lower relative to the second stamping die 3, so that the closing or separation between the first stamping die 2 and the second stamping die 3 is realized. In actual operation, the lifting driver 7 can be a hydraulic telescopic cylinder or an electric telescopic cylinder, etc. As a preferred solution, the lifting driver 7 in the embodiment is an electric telescopic cylinder. The electric telescopic cylinder is in communication with a die displacement controller 1-1 of the control system 1. The die displacement controller 1-1 can adjust the telescopic rate of the electric telescopic cylinder, and then the strain rate of the part is controlled by adjusting the displacement rate of the sliding block 8. The die displacement controller 1-1 also can control the pressure of the part during the hot stamping and stress relaxation stages, that is, the closing pressure of the first stamping die 2 and the second stamping die 3, by adjusting the electric telescopic cylinder.

The closing press is in the form that the second stamping die 3 is fixedly mounted and the first stamping die 2 is driven telescopically. In actual operation, in addition to the above form, the first stamping die 2 can be fixedly mounted on the worktable 6, and the second stamping die 3 is connected with the lifting driver 7, or two lifting drivers 7 are arranged, and the first stamping die 2 and the second stamping die 3 are connected with a lifting driver 7, respectively. The specific arrangement form of the closing press can be adjusted according to actual production requirements. In the solution, one lifting driver 7 is preferably arranged above the worktable 6, the second stamping die 3 is arranged on the worktable 6, and the first stamping die 2 is connected with the lifting driver 7 through the sliding block 8.

In the embodiment, a first cooling structure 9 is further arranged between the first stamping die 2 and the sliding block 8, and a first heat insulation structure 10 is further arranged between the first cooling structure 9 and the first stamping die 2. Similarly, a second cooling structure 11 is further arranged between the second stamping die 3 and the worktable 6, and a second heat insulation structure 12 is further arranged between the second cooling structure 11 and the second stamping die 3. The first heat insulation structure 10 and the second heat insulation structure 12 are both heat insulation plates. The first cooling structure 9 and the second cooling structure 11 are both water cooling plates. The first heat insulation structure 10 and the first cooling structure 9 are arranged between the first stamping die 2 and the sliding block 8 in sequence, and the second heat insulation structure 12 and the second cooling structure 11 are arranged between the second stamping die 3 and the worktable 6 in sequence, so that the heat exchange between the dies and the outside during the forming process can be effectively reduced, and the influence of temperature on other equipment components such as the closing press can be prevented. The water cooling plate is an existing component, and a cooling channel in the water cooling plate is a flowing normal-temperature water cooling channel. The heat insulation plate can be the existing structure, such as a vacuum heat insulation plate or a polyurethane heat insulation plate, and is not described in detail.

In the embodiment, the first stamping die 2 and the second stamping die 3 are arranged vertically to form upper and lower stamping dies, usually one is a male die and the other is a female die. The liftable first stamping die 2 can move up and down along a guide post or a guide sleeve. Usually, the first stamping die 2, the first heat insulation structure 10 and the first cooling structure 9 are fixed on the sliding block 8 by bolts. Correspondingly, the second stamping die 3, the second heat insulation structure 12 and the second cooling structure 11 are usually fixed on the worktable 6 by bolts. The first stamping die 2 and the second stamping die 3 can be made of common die materials for hot forming, such as low-carbon steel, stainless steel and NizN. Asbestos is wound around the outside of the dies to reduce convection and radiation heat exchange between the dies and the external environment during heat transfer process, thereby improving the temperature uniformity of the dies.

In the embodiment, the first die heating assembly and the second die heating assembly are arranged on the first stamping die 2 and the second stamping die 3, respectively, so that die temperature control can be carried out in hot stamping, die quenching and stress relaxation stages. The first die heating assembly specifically includes first heating elements 17 and first thermocouples 18. The first heating elements 17 and the first thermocouples 18 are both inserted at positions corresponding to the first stamping die 2. The first heating elements 17 can be electric heating rods, electric heating wires and other existing structures. Taking the electric heating rods as an example, multiple electric heating rods are inserted at positions corresponding to the first stamping die 2 at intervals. Correspondingly, multiple first thermocouples 18 are also arranged on the first stamping die 2 at intervals. Based on this, the temperature of the dies can be controlled in different zones, and the gradient microstructure can be obtained according to the performance requirements of different deformation zones of the part. Each of the first heating elements 17 and each of the first thermocouples 18 in the first die heating assembly are in communication with the control system 1. In actual operation, the set positions of the first heating elements 17 and the first thermocouples 18 can be adjusted according to the deformation field of the part. A die temperature controller 1-4 of the control system 1 can adjust and maintain the heating temperature of the first heating elements 17 at different positions of the first stamping die 2 through the temperature information fed back by the first thermocouples 18. Specifically, the die temperature controller 1-4 can be a temperature control box.

The structural composition of the second die heating assembly is the same as that of the first die heating assembly. The second die heating assembly includes second heating elements 19 and second thermocouples 20, and the second heating elements 19 and the second thermocouples 20 are both inserted at positions corresponding to the second stamping die 3. The second heating elements 19 can be electric heating rods, electric heating wires and other existing structures. Taking the electric heating rods as an example, multiple electric heating rods are inserted at positions corresponding to the second stamping die 2 at intervals. Correspondingly, multiple second thermocouples 20 are also arranged on the second stamping die 2 at intervals. Based on this, zone control of the temperature of the dies can be realized, and the gradient microstructure can be obtained according to the performance requirements of different deformation zones of the part. Each of the second heating elements 19 and each of the second thermocouples 20 in the second die heating assembly are in communication with the control system 1. In actual operation, the set positions of the second heating elements 19 and the second thermocouples 20 can be adjusted according to the deformation field of the part. The die temperature controller 1-4 of the control system 1 can adjust and maintain the heating temperature of the second heating elements 19 at different positions of the second stamping die 2 through temperature information fed back by the second thermocouples 20. The second thermocouples 20 and the above first thermocouples 18 are both conventional thermocouple structures, and are mainly used for measuring the temperature of the dies. The specific structure and working principle are not described here.

In the embodiment, the axial force control assembly mainly plays a role in controlling the internal stress state of the part during the forming process. In addition to the first horizontal telescopic part 4 and the second horizontal telescopic part 5, force sensors 13 are also provided. The force sensors 13 are arranged on both the first horizontal telescopic part 4 and the second horizontal telescopic part 5. The part to be formed 16 expands or contracts axially during heating, stamping and die quenching. The stress generated in these processes can be fed back to the control system 1 by the force sensors 13, and the stress control during the forming process of the part can be realized through the axial expansion and contraction of the first horizontal telescopic part 4 and the second horizontal telescopic part 5. The first horizontal telescopic part 4 and the second horizontal telescopic part 5 are both horizontal cylinders, and specifically electric telescopic cylinders or hydraulic telescopic cylinders placed horizontally. As a preferred solution, the first horizontal telescopic part 4 and the second horizontal telescopic part 5 in the embodiment are both preferably electric telescopic cylinders placed horizontally, and can drive the part to be formed 16 to expand and contract axially according to the data feedback by the force sensors 13 so as to adjust the internal stress state of the part to be formed 16. Taking the part 16 to be formed as a titanium alloy sheet as an example, during the processes of heating expansion and stamping contraction of the titanium alloy sheet, an axial force change can be fed back to the axial force controller 1-3 of the control system 1 through the force sensors 13. The axial force controller 1-3 realizes the stress control during the forming process of the sheet by controlling the axial (horizontal) expansion and contraction of the first horizontal telescopic part 4 and the second horizontal telescopic part 5. The first horizontal telescopic part 4 and the second horizontal telescopic part 5 cooperate with the aforementioned temperature control dies (that is, upper and lower stamping dies) to form upper, lower, left (front) and right (back) multi-axis loading to jointly control the stress relaxation process of the part, so that the hot forming precision of the part is increased.

In the embodiment, the part heating temperature control assembly is a self-resistance heating system. The self-resistance heating system includes a high-frequency switching power supply, wires and metal electrodes 15. The metal electrodes 15 are configured for closing the part to be formed 16. The metal electrodes 15 are electrically connected with the high-frequency switching power supply through the wires. The working principle of the self-resistance heating system is to use the resistance of the part to be formed 16 for rapid heating. Taking the part to be formed 16 as a titanium alloy sheet as an example, the forming temperature is controlled by a Joule heating effect produced by current flowing into the titanium alloy sheet. The metal electrodes 15 specifically can be copper electrodes. The copper electrodes clamp both ends of the titanium alloy sheet. Through holes are usually formed in the copper electrodes. Close contact between the copper electrodes and the titanium alloy sheet can be ensured through the connection by bolts. The upper and lower sides of the electrodes are electrically connected with the high-frequency switching power supply through wires. High-rated direct current output by the high-frequency switching power supply flows through the titanium alloy sheet through wires, and the titanium alloy sheet is rapidly heated by its own resistance. In order to avoid excessive oxidation of the surface of the sheet and self-regulation of deformation behaviors due to the slow heating under the open condition, the current output of the high-frequency switching power supply can be adjusted by the current controller 1-2 in the control system 1 to control the temperature and heating rate of the titanium alloy sheet. In order to improve the safety of the equipment, thermocouples can also be arranged in the self-resistance heating system. The temperature change of the part to be formed 16 during heating can be fed back to the current controller 1-2 in the control system 1 in real time through the thermocouples. The current controller 1-2 accurately controls the stamping temperature of the part to be formed 16 and the temperature during the die quenching and stress relaxation stages by adjusting the power of the high-frequency switching power supply. The thermocouples of the self-resistance heating system are usually arranged on a side of the sheet and are in direct contact with the sheet for detection. The rated output voltage of the high-frequency switching power supply is usually preferred to be 15 V, and the rated output current is usually preferred to be 10000 A.

Based on the arrangement of the self-resistance heating system, material with low thermal conductivity, such as manganese steel and boron steel, is also arranged between the metal electrodes 15 and the part to be formed 16, so that the heat dissipation of the electrodes at both ends of the part to be formed 16 is reduced, and the uniformity of the temperature field of the part to be formed 16 is improved. At the same time, in order to prevent the current from affecting the normal use of the first horizontal telescopic part 4 and the second horizontal telescopic part 5, the part to be formed 16 is connected with the first horizontal telescopic part 4 and the second horizontal telescopic part 5 through insulation structures. The insulation structures can be ceramic blocks (sheets). Accordingly, in order to further enhance the protection, the insulation structures, such as ceramic blocks (sheets), are also arranged between the metal electrodes 15 and the first horizontal telescopic part 4 and between the metal electrodes 15 and the second horizontal telescopic part 5 to prevent current from flowing into the first horizontal telescopic part 4 and the second horizontal telescopic part 5 through the electrodes to damage the related sensors.

It can be seen that the forming device 100 for a part with a regular cross-section proposed in the embodiment uses resistance heating to control and obtain the microstructure evolution required for hot forming of the part, so that the formability is improved. The die temperature can be controlled for hot stamping, die quenching and stress relaxation. The axial expansion and contraction of the horizontal cylinders can be controlled to adjust the internal stress state of the part. Resistance heating can significantly shorten the heating period, the strength and dimensional precision of the formed part can simultaneously increased though die quenching and stress relaxation, and the internal stress of the part can be further reduced though the multi-axis loading of the stamping dies and the horizontal cylinders and the forming precision of the part are increased. It can be seen that the solution can realize multi-axial loading high-precision hot forming of a part with a regular cross-section, and is suitable for hot forming of a thin-walled part with a regular cross-section. Taking the part to be formed 16 as a titanium alloy thin-walled sheet as an example, the working process and the working principle of the above forming device are explained in detail below.

Firstly, the first heating elements 17 and the second heating elements 19 are connected to the die temperature controller 1-4 (that is, the temperature control box), and the first heating elements 17 and the second heating elements 19 are controlled by the die temperature controller 1-4 to heat the first stamping die 2 and the second stamping die 3, respectively, so that the first stamping die 2 and the second stamping die 3 are heated and adjusted to a target temperature. At the same time, the high-frequency switching power supply is started to quickly heat the titanium alloy thin-walled sheet.

Then, the first stamping die 2 is driven down by the lifting driver 7, so that the first stamping die 2 and the second stamping die 3 are quickly closed so as to stamp the titanium alloy thin-walled sheet to form a first preformed member. After the first stamping die 2 and the second stamping die 3 are closed, the first preformed member is kept for a period of time under the pressure and temperature. At the same time, the axial stress change during the stamping process of the titanium alloy thin-walled sheet is fed back to the first horizontal telescopic part 4 and the second horizontal telescopic part 5 by the force sensors 13, and the internal stress of the first preformed member is controlled by the axial expansion and contraction of the first horizontal telescopic part 4 and the second horizontal telescopic part 5. The microstructure evolution in different deformation zones of the titanium alloy thin-walled sheet can be controlled by die quenching in different zones of the dies, and the springback can be reduced and the stress state of the first preformed member can be controlled under the multi-axial loading of stress relaxation in the dies and axial stress of the horizontal telescopic parts, so that the strength and dimensional precision of the formed part are increased.

The above solution has the following specific beneficial effects.

Firstly, the forming efficiency is high. The titanium alloy thin-walled sheet is heated by resistance, the heating period can be significantly shortened, the heat loss during the process of transferring billets from a traditional heating furnace is avoided, so that the forming efficiency can be significantly increased, and the process energy consumption is reduced. The heating elements and the thermocouples are arranged in the temperature control die assembly, and hot forming, die quenching and stress relaxation can be combined into a single process, so that the integration of shape control and performance control for the titanium alloy thin-walled sheet is realized, and the formability and production efficiency are significantly improved.

Secondly, the forming precision is high. Moreover, the strength and dimensional precision of the formed part can be increased though die quenching and stress relaxation. The cooperation of the temperature control die assembly and the horizontal cylinders of the axial force control assembly can realize multi-axis loading to jointly control the stress relaxation process of the part. During stamping, the sheet cools and shrinks, and the horizontal cylinders can be fixed to limit the shrinkage of the part and form tensile stress. At the same time, the sheet can be kept for a period of time under the preset die temperature and the closing pressure, resulting in stress relaxation, and reducing the springback. After stamping, the horizontal cylinders can axially pull the sheet to apply constant prestress, so that the forming precision is increased. On the premise of increasing the precision of the part, the temperature window of the forming dies can be further widened, and the microstructure properties of the formed part can be effectively controlled by increasing the supercooling degree.

Thirdly, the microstructure can be controlled and the gradient microstructure can be achieved. The output of resistance heating current can be adjusted, and reasonable heating parameters (temperature and heating rate) can be designed to obtain well-matched two-phase distribution and grain size, so that the formability of the part is improved. The cooling rate of die quenching can be controlled by adjusting the temperature of the dies, so that the martensitic transformation trend required by the strength of the member can be obtained. Moreover, zoning control for the temperature of the dies can be realized, and the gradient microstructure can be obtained according to the performance requirements of different deformation zones of the part.

The device and the method in the present disclosure can combine hot forming, heat treatment and hot sizing into a single process, and can realize the integration of shape control and performance control for hot forming of the titanium alloy part in cooperation with the arrangement of the control system, so that the production efficiency is greatly increased while ensuring the performance and dimensional precision of the part.

Embodiment II

Figure 4:
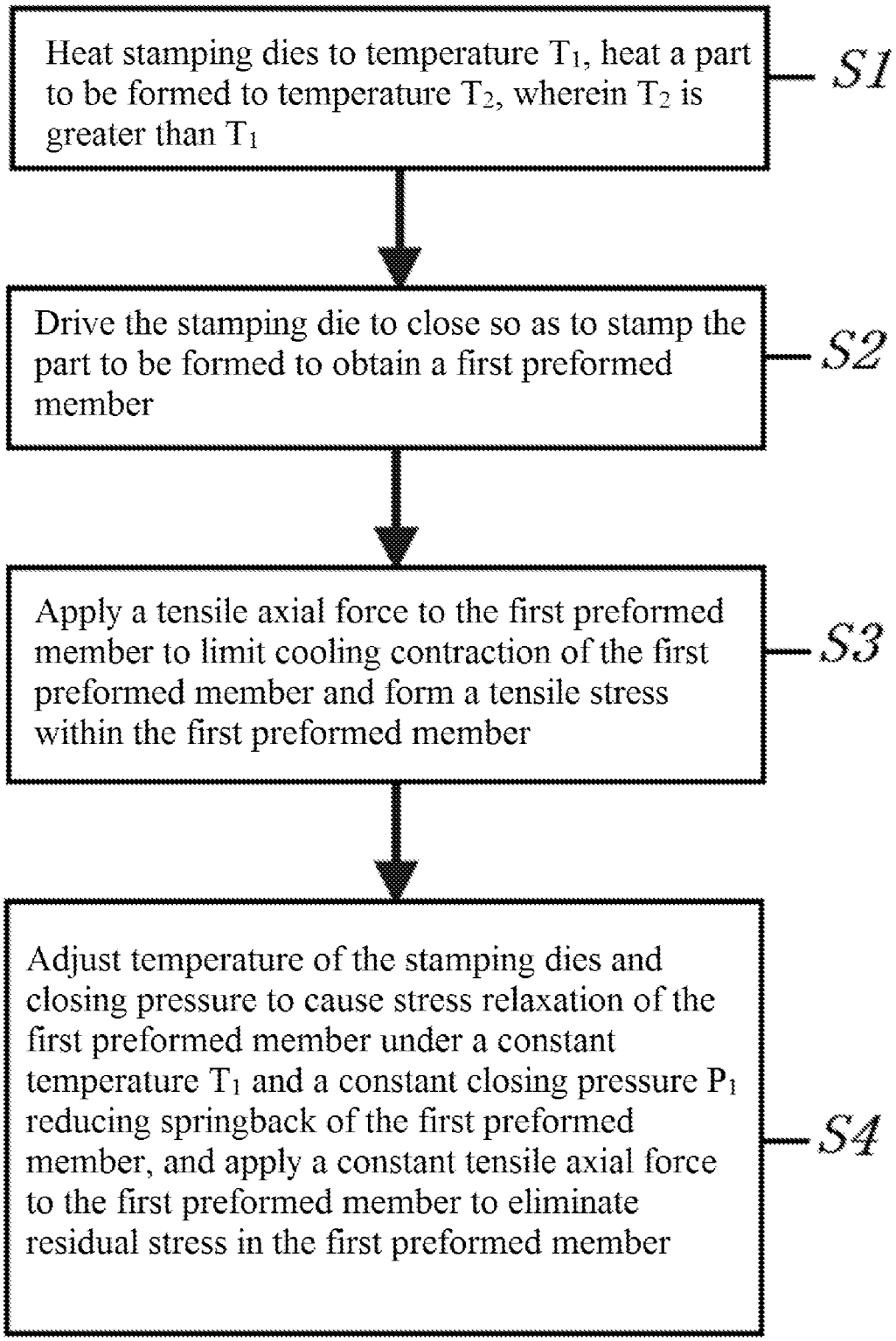
FIG. 4 is a flow diagram of a forming method for a part with a regular cross-section disclosed in an embodiment of the present disclosure.

As shown in FIG. 4, the embodiment provides a forming method for a part with a regular cross-section, including the following steps:

- S1, stamping dies are heated to temperature $T_1$, a part to be formed 16 is heated to temperature $T_2$, wherein $T_2$ is greater than $T_i$;
- S2, the stamping die is driven to perform a closing, so as to stamp the part to be formed 16 to obtain a first preformed member;
- S3, a tensile axial force is applied to the first preformed member to limit cooling contraction of the first preformed member and form a tensile stress within the first preformed member; and
- S4, the temperature of the stamping dies and the closing pressure are adjusted, resulting in stress relaxation of the first preformed member under a constant temperature $T_i$and a constant closing pressure $P_1$, reducing the springback of the component, and a constant tensile axial force is applied to the first preformed member to eliminate residual stress in the first preformed member.

The forming method for a part with a regular cross-section can be implemented by the forming device 100 for a part with a regular cross-section in embodiment I, thereby forming a multi-axis loading high-precision hot forming method for a part with a regular cross-section, which is suitable for hot forming of a thin-walled part with a regular cross-section. Taking the part to be formed 16 as a titanium alloy thin-walled sheet as an example, the working principle of the above forming method for a part with a regular cross-section are explained in detail below. The forming method includes the following specific steps:

- Step 1, stamping dies are heated and adjusted to temperature $T_1$, and the temperature is kept for a period of time to ensure temperature uniformity of all points inside the dies; a titanium alloy thin-walled sheet is heated rapidly to a forming temperature $T_2$ by a self-resistance heating system so as to obtain a microstructure with good plasticity, wherein $T_2$ is greater than $T_1$.
- Step 2, after the dies and the titanium alloy thin-walled sheet are heated, the stamping dies are driven quickly to perform a closing, and during the process of the closing, the part to be formed 16 is formed gradually to obtain a first preformed member; after the dies are closed, using the lifting driver 7 to press the dies continuously so as to ensure that the titanium alloy thin-walled sheet is in full contact with the inner wall of the die cavity during the forming process.
- Step 3, after stamping, the first preformed member cools and shrinks, and a first horizontal telescopic part 4 and a second horizontal telescopic part 5 are kept fixed so as to limit the shrinkage of the first preformed member, a tensile stress is formed in the first preformed member.
- Step 4, finally, the temperature control and pressure control technology of the dies cause stress relaxation of the first preformed member under a constant temperature $T_i$ of the dies and a constant pressure $P_1$, so as to reduce the springback of the first preformed member, after the temperature of the first preformed member is reduced to $T_1$, the first preformed member is pulled axially by the first horizontal telescopic part 4 and the second horizontal telescopic part 5, and a constant prestress is applied to the first preformed member, thus not only eliminating the residual stress in the first preformed member, but also ensuring the strength and dimensional precision of the formed part.

In step 1 above, the temperature of the dies can be controlled in different zones, and the temperature is in the range of 0° C. to 700° C.

In step 1 above, the forming temperature of the titanium alloy thin-walled sheet is in the range of 700° C. to 1000° C., and the heating rate is in the range of 1° C./s to 100° C./s.

In step 2 above, the closing pressure is in the range of 50 t to 1000 t.

In step 4 above, the axial expansion and contraction rate of the first horizontal telescopic part 4 and the second horizontal telescopic part 5 is in the range of 0.1 mm/min to 100 mm/min.

Compared with the prior art, the embodiment has the following beneficial effects.

The multi-axis loading high-precision hot forming method for a part with a regular cross-section controls the heating process of the titanium alloy thin-walled sheet with resistance heating to obtain a microstructure required for hot forming, so that the formability is improved. The temperature of the dies can be controlled for hot stamping, die quenching and stress relaxation, and the temperature of the dies can be controlled in different zones. The gradient microstructure can be obtained according to the performance requirements of different deformation zones of the part. The axial displacement of the horizontal cylinders can be controlled to asjust the internal stress state of the titanium alloy thin-walled sheet. The heating period can be significantly shortened by using resistance heating for the titanium alloy thin-walled sheet, so that the temperature loss during the process of transferring billets from a traditional heating furnace is avoided. Die quenching and stress relaxation can simultaneously increase the strength and dimensional precision of the formed part. The stamping dies and the horizontal cylinders cooperate to form multi-axial loading so as to jointly control the stress relaxation process of the part. On the premise of increasing the precision of the part, the temperature window of the forming dies can be further widened, and the microstructure properties of the formed part can be effectively controlled by increasing the supercooling degree. according to the method, hot forming and heat treatment can be combined into a single process, and the integration of shape control and performance control for hot forming of the titanium alloy part is realized, so that the production efficiency is greatly increased while ensuring the performance and dimensional precision of the part.

Embodiment III

Figure 5:
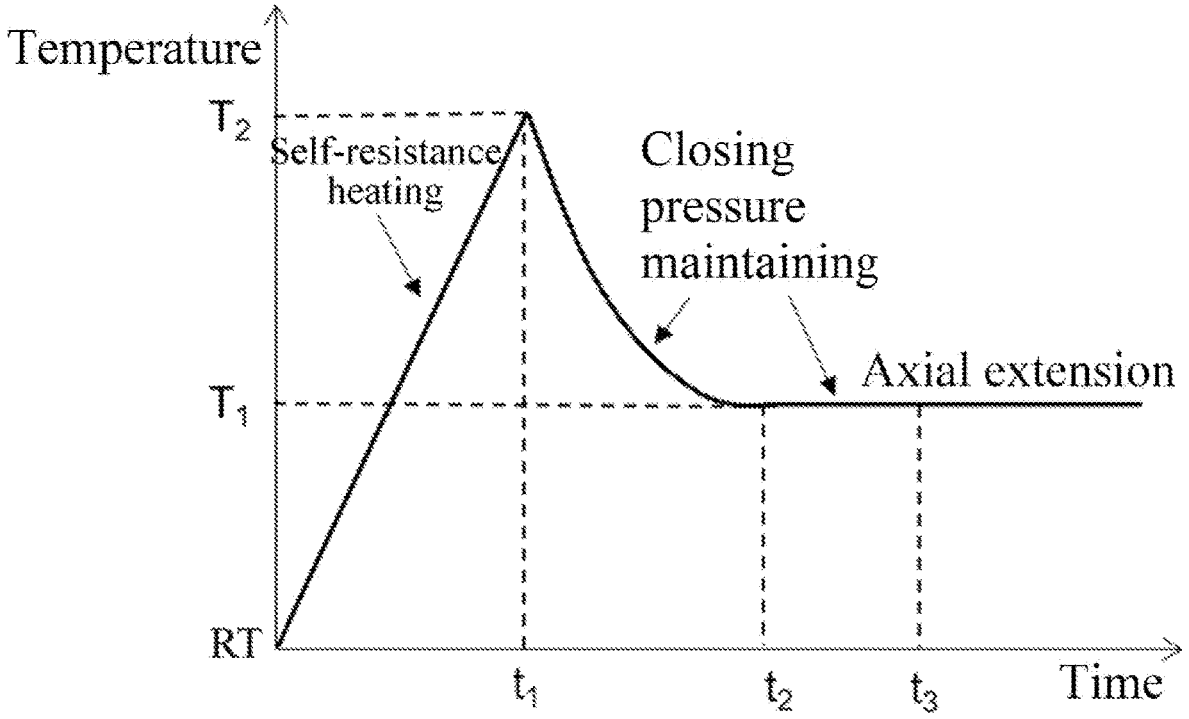
FIG. 5 is an evolution diagram of forming temperature of the part disclosed in the embodiment of the present disclosure.
Figure 6:
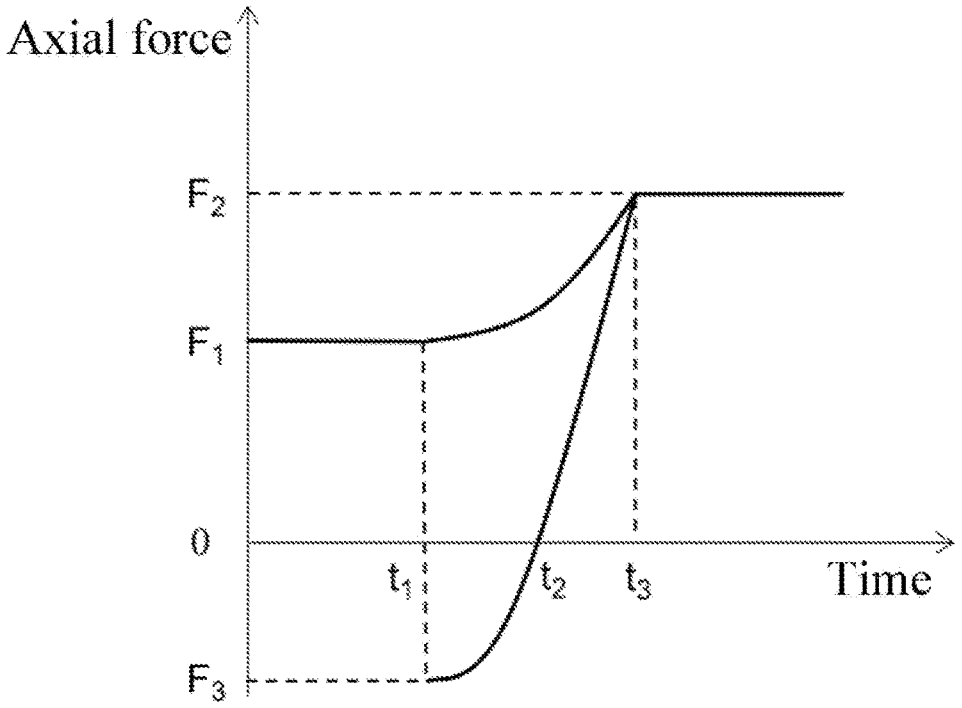
FIG. 6 an evolution diagram of the axial force on the part disclosed in the embodiment of the present disclosure.

As shown in FIG. 5 and FIG. 6, which are evolution diagrams of hot forming temperature and stress of a titanium alloy thin-walled part with a regular cross-section in the embodiment. The hot forming process of the titanium alloy thin-walled part with a regular cross-section includes the following steps:

Step 1, stamping dies are heated and adjusted to temperature $T_1$, and the temperature is kept for a period of time t to ensure temperature uniformity of all points inside the dies; a titanium alloy thin-walled sheet is heated rapidly to a forming temperature $T_2$ at a heating rate $H_1$ by a self-resistance heating system so as to obtain a microstructure with good plasticity, wherein $T_2$ is greater than $T_1$. The titanium alloy thin-walled sheet is heated and expanded during the heating process. During this process, the first horizontal telescopic part 4 and the second horizontal telescopic part 5 press the titanium alloy thin-walled sheet axially to avoid the expansion and bending deformation of the titanium alloy thin-walled sheet.

Step 2, after the dies and the titanium alloy thin-walled sheet are heated, the stamping dies are driven quickly to perform a closing, and during the process of the closing, the part to be formed 16 is formed gradually to obtain a first preformed member; after the dies are closed, using the lifting driver 7 to press the dies continuously so as to ensure that the titanium alloy thin-walled sheet is in full contact with the inner wall of the die cavity during the forming process.

Step 3, after stamping, the first preformed member cools and shrinks, and a first horizontal telescopic part 4 and a second horizontal telescopic part 5 are kept fixed so as to limit the shrinkage of the first preformed member, a tensile stress is formed in the first preformed member.

Step 4, finally, the temperature control and pressure control technology of the dies cause stress relaxation of the first preformed member under a constant temperature $T_1$ of the dies and a constant pressure $P_1$ so as to reduce the springback of the first preformed member, after the temperature of the first preformed member is reduced to $T_1$, the first preformed member is pulled axially by the first horizontal telescopic part 4 and the second horizontal telescopic part 5, and a constant prestress is applied to the first preformed member, thus not only eliminating the residual stress in the first preformed member, but also ensuring the strength and dimensional precision of the formed part.

Embodiment IV

Figure 7:
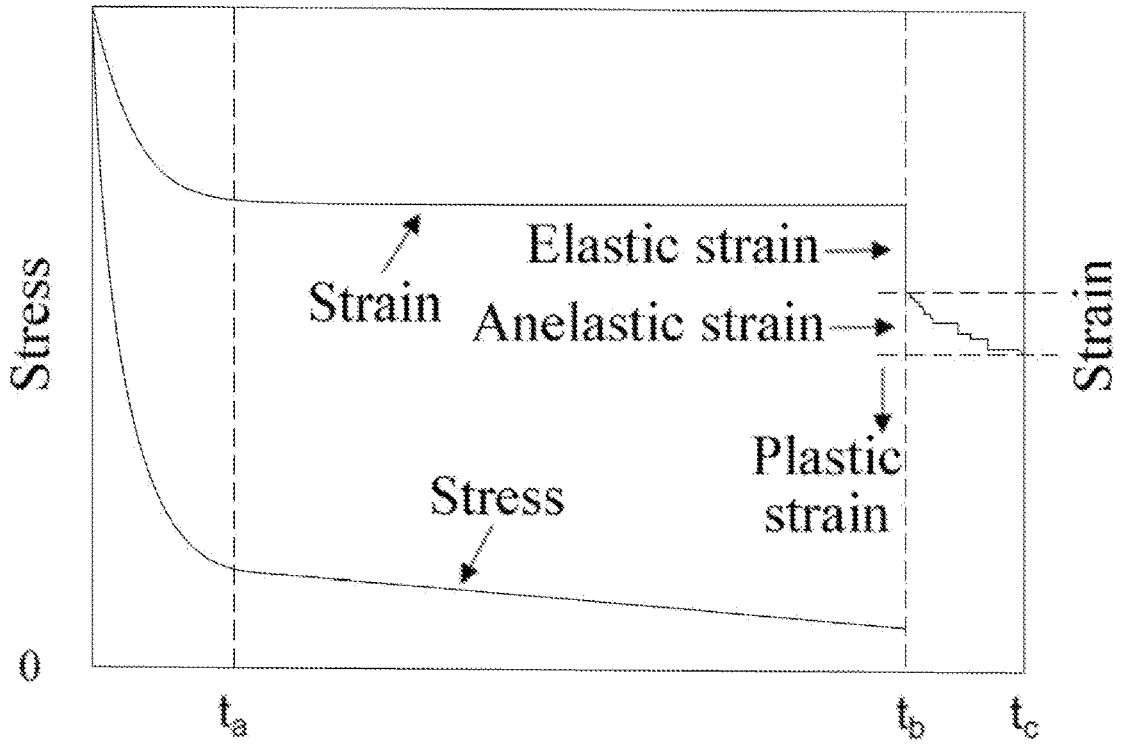
FIG. 7 is an evolution diagram of forming stress of the part disclosed in the embodiment of the present disclosure.
Figure 8:
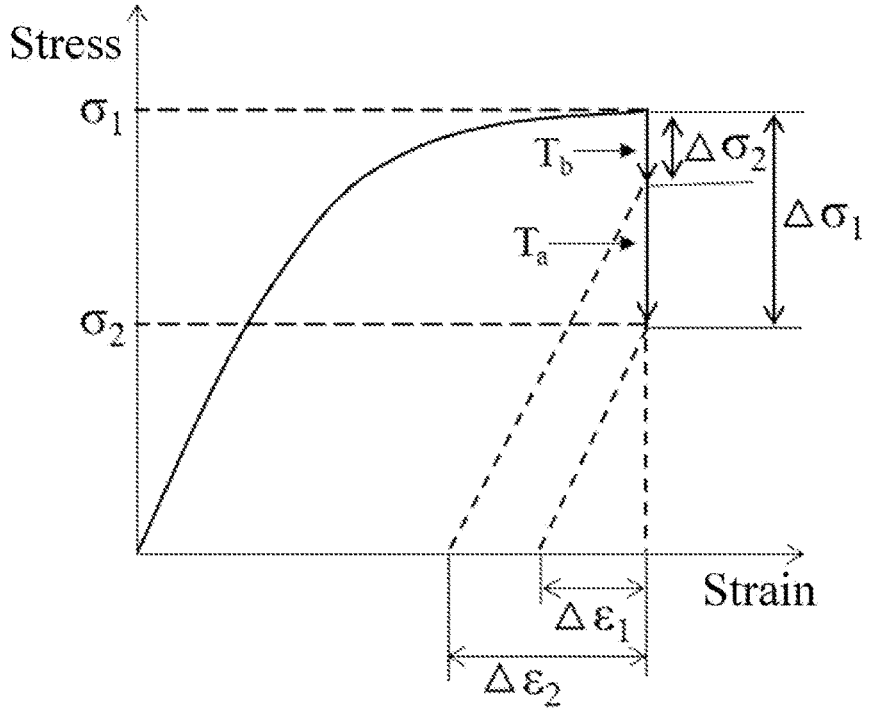
FIG. 8 is an evolution diagram of stress strain of the part disclosed in the embodiment of the present disclosure.
Figure 9:
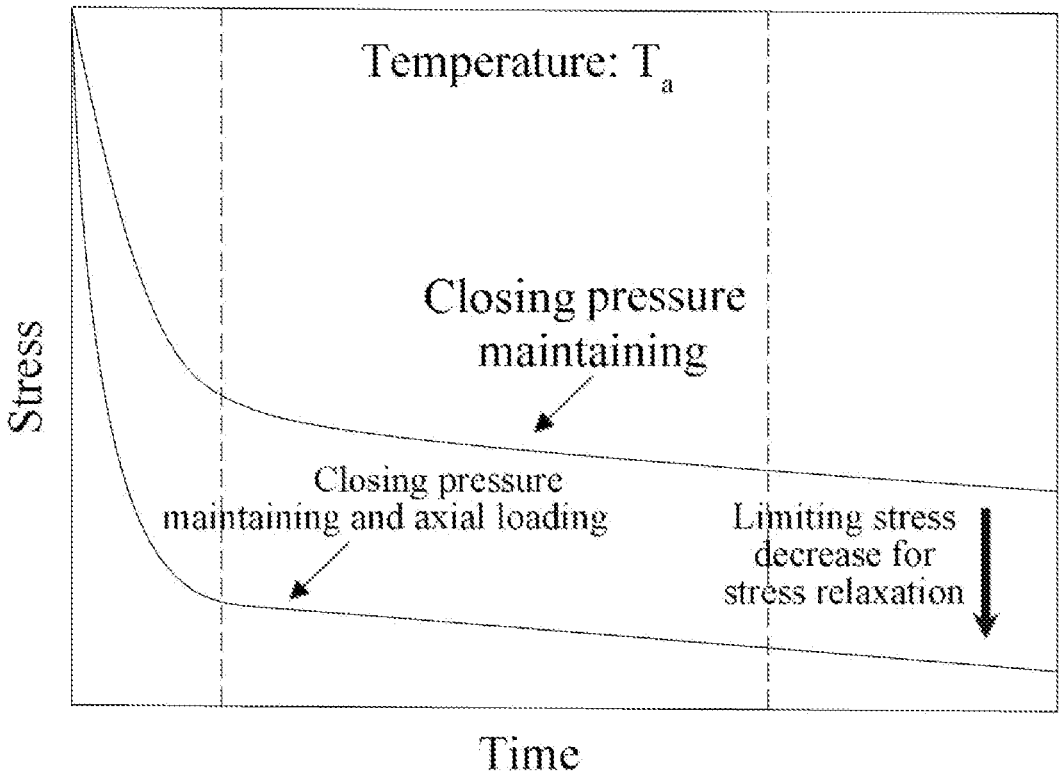
FIG. 9 a mechanism diagram of high-pressure stress relaxation and shaping in the dies of the part disclosed in the embodiment of the present disclosure.

As shown in FIG. 7 to FIG. 9, a mechanism for high-pressure stress relaxation forming process in the dies of a titanium alloy thin-walled sheet with a regular cross section in the embodiment is reflected.

The part made from the titanium alloy sheet after hot stamping is large in springback, and often require further hot sizing to reduce its springback. The hot sizing process is proposed based on the stress relaxation effect of the material. Stress relaxation refers to the process that the stress of the material is decreased with time while the total strain of the material is constant. During this process, the elastic strain of the material is changed into plastic strain, and finally remains in the material, and then the decrease of the elastic strain leads to the decrease of the springback amount of the part after unloading. The temperature of the titanium alloy sheet is still high after forming, and the temperature of the sheet can be reduced to the die temperature $T_1$ by further pressure maintaining. During the process of pressure maintaining, an obvious stress relaxation effect will occur on the titanium alloy sheet, so that the springback of the complex thin-walled member after hot forming can be reduced by the stress relaxation effect.

As shown in FIG. 7, when the strain of the hot stamped part reaches a target value, the temperature $T_1$ of the dies and the closing pressure $P_1$ of the press remain unchanged, the internal stress of the titanium alloy formed part shows a rapid downward trend in the first stage (0-$t_a$) of stress relaxation, and the first stage lasts for a short time under the deformation condition. And then, in the second stage of stress relaxation, the stress decreases very slow and a relatively stable stress level appears, and the second stage lasts until $t_b$ under this condition. And then, the closing pressure is unloaded ($t_b$-$t_c$), and the part is freely deformed. At this time, the elastic strain recovers immediately, and then the anelastic strain gradually decreases with time until a balanced state is reached.

With the increase of relaxation time, the residual stress of the hot stamped part approaches the stress relaxation limit infinitely. In FIG. 8, the temperature $T_a$ of the dies is greater than $T_b$ in the stress relaxation stage, the higher the temperature, the faster the stress relaxation is caused. The lower the stress relaxation limit stress, the smaller the springback $\Delta\varepsilon$ is. In FIG. 9, the internal stress of the hot stamped part during the stress relaxation process can be fed back in real time through force sensors in an axial force and displacement control system. The horizontal cylinders can further reduce the internal stress of the hot stamped part by axial displacement, and cooperates with the stamping dies to form multi-axis loading to jointly control the stress relaxation process of the part. On the premise of increasing the part precision, the temperature window of the forming die can be further broadened. By reducing the temperature of the die, energy consumption can be reduced, and the quenching and cooling rate of the formed part in the die can be increased, and the microstructure properties of the part can be controlled.

Embodiment V

FIG. 6 is a schematic diagram of multi-axial loading high-precision hot forming of a titanium alloy thin-walled sheet with a regular cross-section in the embodiment. Taking TC4 titanium alloy as an example, the hot forming process includes the following steps:

Step 1, stamping dies are heated and adjusted to 300° C., and keeping the temperature for a period of 5 min to ensure temperature uniformity of all points inside the dies; a titanium alloy sheet is heated rapidly to 900° C. at a heating rate of 50° C./s by a self-resistance heating system so as to obtain a microstructure with good plasticity. The titanium alloy walled sheet is heated and expanded during the heating process. During this process, the first horizontal telescopic part 4 and the second horizontal telescopic part 5 press the titanium alloy thin-walled sheet axially to avoid the expansion and bending deformation of the TC4 titanium alloy sheet.

Step 2, after the dies and the TC4 titanium alloy sheet are heated, the stamping dies are driven quickly to perform a closing, and during the process of the closing, the part to be formed 16 is formed gradually to obtain a first preformed member; after the dies are closed, using the lifting driver 7 to press the dies continuously so as to ensure that the TC4 titanium alloy sheet is in full contact with the inner wall of the die cavity during the forming process.

Step 3, after stamping, the first preformed member cools and shrinks, and a first horizontal telescopic part 4 and a second horizontal telescopic part 5 are kept fixed so as to limit the shrinkage of the first preformed member, a tensile stress is formed in the first preformed member.

Step 4, finally, through the temperature control and pressure control technology of the dies, stress relaxation of the first preformed member is caused under a constant temperature of 300° C. and a constant pressure of 500 Mpa so as to reduce the springback of the first preformed member, after the temperature of the first preformed member is reduced to 300° C., the first preformed member is pulled axially by the first horizontal telescopic part 4 and the second horizontal telescopic part 5, and a constant prestress is applied to the first preformed member, thus not only eliminating the residual stress in the first preformed member, but also ensuring the strength and dimensional precision of the formed part.

To sum up, according to the multi-axial loading high-precision hot forming device and method for a titanium alloy thin-walled sheet with a regular cross-section proposed in the embodiment, through self-resistance heating of the titanium alloy sheet, the heating efficiency can be significantly increased, the temperature loss in the process of transferring billets is avoided, the experimental period is shortened, the microstructure evolution can be controlled, and the formability is improved. Non-isothermal hot stamping and die quenching can combine hot stamping and heat treatment in a single process, so that the formability and production efficiency are improved, the temperature of the dies can be controlled in different zones, and the gradient microstructure is obtained according to the performance requirements of different deformation zones of the part. The stress relaxation in the dies and the axial expansion and contraction of the horizontal cylinders can realize stress relaxation and multi-axial stress loading of the part, and creep sizing is carried out on the part, so that the springback caused by traditional cold stamping is effectively reduced, the process cycle is shortened, and the dimensional precision is increased.

It needs to be noted that for those skilled in the art, obviously the present disclosure is not limited to the details of the exemplary embodiment, and the present disclosure can be achieved in other specific forms without departing from the spirit or essential characteristics of the present disclosure. Therefore, for every point, the embodiments should be regarded as exemplary embodiments and are unrestrictive, the scope of the present disclosure is defined by the appended claims, therefore, all changes, including the meanings and scopes of equivalent elements, of the claims are aimed to be included in the present disclosure, and any reference signs in the claims should not be regarded as limitation to the involved claims.

Specific examples are used for illustration of the principles and implementation methods of the present disclosure. The description of the above-mentioned embodiments is used to help illustrate the method and its core principles of the present disclosure. In addition, those skilled in the art can make various modifications in terms of specific embodiments and scope of application in accordance with the teachings of the present disclosure. In summary, the contents of this specification should not be understood as the limitation of the present disclosure.

What is claimed is:

1. A forming device for a part with a regular cross-section, comprising:

a temperature control die, comprising a first stamping die and a second stamping die, a first die heating assembly being arranged on the first stamping die and a second die heating assembly being arranged on the second stamping die; wherein the first stamping die and the second stamping die are arranged vertically;

a closing driving assembly connected with at least one of the first stamping die and the second stamping die and configured for driving the first stamping die and the second stamping die to close so as to stamp a part to be formed; wherein the closing driving assembly is a closing press, the closing press comprises a worktable, a lifting driver, and a sliding block connected with the lifting driver, the lifting driver is located above the worktable, the second stamping die is arranged on the worktable, and the first stamping die is connected with the sliding block; a first cooling structure is further arranged between the first stamping die and the sliding block, and a first heat insulation structure is further arranged between the first cooling structure and the first stamping die; and a second cooling structure is further arranged between the second stamping die and the worktable, and a second heat insulation structure is further arranged between the second cooling structure and the second stamping die;

a part heating temperature control assembly configured for heating the part to be formed;

an axial force control assembly configured for applying an axial force to the part to be formed during a process of heating expansion or stamping contraction of the part to be formed, a direction of the axial force being perpendicular to a closing direction of the first stamping die and the second stamping die to adjust an internal stress of the part to be formed; wherein the axial force control assembly comprises a first horizontal telescopic part and a second horizontal telescopic part located on both sides of the second stamping die, and the first horizontal telescopic part and the second horizontal telescopic part are configured for both connecting with the part to be formed to achieve stress control of the part to be formed through synchronization expansion and contraction; wherein the axial force control assembly further comprises force sensors; and the force sensors are arranged on both the first horizontal telescopic part and the second horizontal telescopic part to detect the axial force of the part to be formed during the process of heating expansion or stamping contraction; and a control system in communication with the axial force control assembly, the part heating temperature control assembly, the closing driving assembly, the first die heating assembly and the second die heating assembly.

2. The forming device for a part with a regular cross-section according to claim 1, wherein the first heat insulation structure and the second heat insulation structure are both heat insulation plates; and the first cooling structure and the second cooling structure are both water cooling plates.

3. The forming device for a part with a regular cross-section according to claim 1, wherein the first die heating assembly comprises first heating elements and first thermocouples, and the first heating elements and the first thermocouples are both inserted at positions corresponding to the first stamping die; and the second die heating assembly comprises second heating elements and second thermocouples, and the second heating elements and the second thermocouples are both inserted at positions corresponding to the second stamping die.

4. The forming device for a part with a regular cross-section according to claim 1, wherein the part heating temperature control assembly is a self-resistance heating system, the self-resistance heating system comprises a high-frequency switching power supply, wires and metal electrodes, the metal electrodes are configured for closing the part to be formed, and the metal electrodes are electrically connected with the high-frequency switching power supply through the wires; and the part to be formed is connected with the first horizontal telescopic part and the second horizontal telescopic part through insulation structures.

5. The forming device for a part with a regular cross-section according to claim 4, wherein the first horizontal telescopic part and the second horizontal telescopic part are both horizontal cylinders.

6. The forming device for a part with a regular cross-section according to claim 2, wherein the first die heating assembly comprises first heating elements and first thermocouples, and the first heating elements and the first thermocouples are both inserted at positions corresponding to the first stamping die; and the second die heating assembly comprises second heating elements and second thermocouples, and the second heating elements and the second thermocouples are both inserted at positions corresponding to the second stamping die.

7. The forming device for a part with a regular cross-section according to claim 2, wherein the part heating temperature control assembly is a self-resistance heating system, the self-resistance heating system comprises a high-frequency switching power supply, wires and metal electrodes, the metal electrodes are configured for closing the part to be formed, and the metal electrodes are electrically connected with the high-frequency switching power supply through the wires; and the part to be formed is connected with the first horizontal telescopic part and the second horizontal telescopic part through insulation structures.

8. The forming device for a part with a regular cross-section according to claim 7, wherein the first horizontal telescopic part and the second horizontal telescopic part are both horizontal cylinders.

9. A forming method which is implemented by using the forming device according to claim 1, comprising the following steps:

S1: heating the first stamping die and the second stamping die to temperature $T_1$, heating the part to be formed to temperature $T_2$, wherein $T_2$ is greater than $T_1$;

S2: driving the first stamping die and the second stamping die to close so as to stamp the part to be formed to obtain a first preformed member;

S3: applying a tensile axial force to the first preformed member to limit cooling contraction of the first preformed member and form a tensile stress within the first preformed member; and S4: adjusting temperature of the first stamping die and the second stamping die and a closing pressure to cause stress relaxation of the first preformed member under a constant temperature $T_1$ and a constant closing pressure $P_1$, reducing springback of the member, and applying a constant tensile axial force to the first preformed member to eliminate residual stress in the member.

10. The forming method according to claim 9, wherein the first heat insulation structure and the second heat insulation structure are both heat insulation plates; and the first cooling structure and the second cooling structure are both water cooling plates.

11. The forming method according to claim 9, wherein the first die heating assembly comprises first heating elements and first thermocouples, and the first heating elements and the first thermocouples are both inserted at positions corresponding to the first stamping die; and the second die heating assembly comprises second heating elements and second thermocouples, and the second heating elements and the second thermocouples are both inserted at positions corresponding to the second stamping die.

12. The forming method for a part with a regular cross-section according to claim 10, wherein the first die heating assembly comprises first heating elements and first thermocouples, and the first heating elements and the first thermocouples are both inserted at positions corresponding to the first stamping die; and the second die heating assembly comprises second heating elements and second thermocouples, and the second heating elements and the second thermocouples are both inserted at positions corresponding to the second stamping die.

13. The forming method according to claim 9, wherein the part heating temperature control assembly is a self-resistance heating system, the self-resistance heating system comprises a high-frequency switching power supply, wires and metal electrodes, the metal electrodes are configured for closing the part to be formed, and the metal electrodes are electrically connected with the high-frequency switching power supply through the wires; and the part to be formed is connected with the first horizontal telescopic part and the second horizontal telescopic part through insulation structures.

14. The forming method according to claim 10, wherein the part heating temperature control assembly is a self-resistance heating system, the self-resistance heating system comprises a high-frequency switching power supply, wires and metal electrodes, the metal electrodes are configured for closing the part to be formed, and the metal electrodes are electrically connected with the high-frequency switching power supply through the wires; and the part to be formed is connected with the first horizontal telescopic part and the second horizontal telescopic part through insulation structures.

15. The forming method according to claim 13, wherein the first horizontal telescopic part and the second horizontal telescopic part are both horizontal cylinders.

16. The forming method according to claim 14, wherein the first horizontal telescopic part and the second horizontal telescopic part are both horizontal cylinders.

* * * * *